US006024264A

United States Patent [19]

Java

[11] Patent Number: 6,024,264

[45] Date of Patent: Feb. 15, 2000

[54] COLLAPSIBLE BACKPACK HOOD APPARATUS

[76] Inventor: Rodney T. Java, 114 Arleta Ave., San Francisco, Calif. 94134

[21] Appl. No.: 09/039,587

[22] Filed: Mar. 16, 1998

Related U.S. Application Data

[63] Continuation-in-part of application No. 08/877,248, Jun. 17, 1997, abandoned, which is a continuation of application No. 08/704,327, Aug. 28, 1996, abandoned.

[51] Int. Cl.[7] ..... A45B 11/02

[52] U.S. Cl. ..... 224/576; 135/16; 224/186; 224/0.5

[58] Field of Search ..... 224/190, 188, 224/186, 181, 576, 261, 0.5; 135/16, 21, 90, 96, 151

[56] References Cited

U.S. PATENT DOCUMENTS

| | | | |
|---|---|---|---|
| 53,149 | 3/1866 | Jennings | 2/4 |
| 1,803,538 | 5/1931 | Pistole | 224/187 |
| 4,112,957 | 9/1978 | Biven | 224/190 X |
| 4,179,053 | 12/1979 | Figura | 224/190 |
| 4,657,037 | 4/1987 | Garrido et al. | 135/90 |
| 4,687,414 | 8/1987 | Wardy | 416/63 |
| 4,739,784 | 4/1988 | Fast | 135/96 X |
| 4,810,030 | 3/1989 | Lewis | 135/96 X |

FOREIGN PATENT DOCUMENTS

| | | | |
|---|---|---|---|
| 78880 | 10/1919 | Austria | 224/190 |

*Primary Examiner*—Renee S. Luebke
*Attorney, Agent, or Firm*—Douglas E. White

[57] ABSTRACT

A retractable hood or canopy attaches to the top portion of an internal or external backpack frame. Preferably, one or more exterior solar panels are mounted on the top of the hood and power one or more electric fans which cool the head of the backpacker while hiking. Two open-ended C-bands make up the internal frame structure of the hood. A waterproof cloth material covers these frame members. Mosquito netting is attached along the lower frame of the hood using hook and loop fastener material. An optional atomizing feature provides a further cooling effect to the head of a user by directing water onto the head of the user in the form of a cooling mist.

30 Claims, 13 Drawing Sheets

COLLAPSIBLE BACKPACK HOOD APPARATUS

CROSS REFERENCE TO RELATED APPLICATIONS

This application is a continuation in part of U.S. application Ser. No. 08/877,248, filed Jun. 17, 1997, which is a continuation of U.S. application Ser. No. 08/704,327, filed Aug. 28, 1996, both of which are now abandoned.

FIELD OF THE INVENTION

This invention relates to backpacking equipment, more particularly to an apparatus for providing sun protection and heat relief to the head of a backpacker.

BACKGROUND OF THE INVENTION

Backpacking is an enjoyable outdoor activity practiced by millions. It is, however, a strenuous form of exercise that warms the practitioner. If undertaken on a particularly hot and cloudless day, discomfort can arise due to overheating—particularly if done in steep terrain. There is even a danger of heat exhaustion if precautions are not taken.

Backpackers resist, however, the use of hats—which not only obstruct their view of the natural surroundings they came to enjoy, but even can add to the problem of heat retention and build-up.

There is a need, therefore, for a backpacking accessory which can provide solar protection to the user comfortably and effortlessly. There is also a need for such an accessory which not only prevents sun from reaching the packer's head, but which can be affirmatively employed to cool the packer, thereby relieving heat discomfort built up not only from solar exposure, but also from the packer's own exertions.

Prior developments in this field may be generally illustrated by reference to the following information:

| Patent No. | Patentee | Issue Date |
|---|---|---|
| 4,687,414 | W. Wardy | Aug. 18, 1987 |
| 5,000,210 | T. Worthington, Jr. | Mar. 19, 1991 |
| D339,912 | K. Delauter | Oct. 5, 1993 |
| 5,397,268 | K. Chang et al. | Mar. 14, 1995 |
| 5,102,190 | H. Akin et al. | Apr. 7, 1992 |
| 5,203,363 | W. Kidwell et al. | Apr. 20, 1993 |
| 4,112,957 | E. Biven | Sep. 12, 1978 |
| 4,170,242 | F. Caso | Oct. 9, 1979 |
| 4,179,053 | G. Figura | Dec. 18, 1979 |
| 4,657,037 | H. Garrido et al. | Apr. 14, 1987 |
| 5,282,557 | J. McCook | Feb. 1, 1994 |
| 1,803,538 | H. Pistole | May 5, 1931 |
| 4,162,764 | R. Millsap | Jul. 31, 1979 |
| 1,577,345 | J. Nagorski et al. | March 16, 1926 |

In column 4, lines 26–33 of U.S. Pat. No. 4,112,957 it is stated that hook and loop fastener material permits attachment of mosquito netting and plastic coverings to a backpack canopy.

U.S. Pat. Nos. 4,170,242 and 4,179,053 teach body-supported canopies that are collapsible or adjustable from one position to another.

U.S. Pat. No. 4,657,037 teaches a sun protector with a built-in fan. U.S. Pat. No. 4,687,414 shows a battery-powered fan in a backpack apparatus. The power source of U.S. Pat. No. 4,657,037 is not disclosed. Neither of these patents teach the use of solar panels.

U.S. Pat. No. 5,282,557 teaches a liquid carrier with hand pump in combination with a harness.

U.S. Pat. No. 1,803,538 teaches an arcuate movement of fabric covered hoops when the device thereof is being collapsed.

The rest of the patents are representative of what is to be found in the art.

SUMMARY OF THE INVENTION

The invention comprises a retractable hood or canopy which attaches to the op portion of an internal or external backpack frame. One or more exterior low wattage solar panels may be mounted on the top of the hood. This powers one or more low voltage electric motors with fan blades. The fans may be mounted on the inside rim of the front of the hood or inside the top of the hood. The purpose of the fans is to cool the head of the backpacker while hiking. The fans are adjustable, to position the direction of air coming therefrom. An on and off switch is mounted either on the solar panels or on the fan motor assemblies. The solar panel may be either a flat panel or a design which allows maximum reception of sunlight; e.g., a triangle, pyramid, square or the like. The solar panel may be mounted either in a fixed position or on an adjustable swivel hinge. Flexible solar panel patches might be affixed directly to the fabric of the hood. Wires leading from the solar panel to the motor assembly can be routed along or through the leading edge seams of the hood.

The hood is constructed with known and readily available materials. Two rigid flat bars or cylindrical rods made of plastic or fiberglass, hereinafter "C-bands," intersect at their ends. They form two open-ended C-shaped hoops which can be separated at a maximum angle or arc of up to about 60 degrees or more. The opposite ends of the hoops are held apart and are attached in common at two pivot points. One hoop is able to pivot about these points, while the other remains fixed in position with respect to the backpack frame. The C-band members make up the internal frame structure of the hood. A waterproof cloth material covers the frame members and stretches between them. One of the C-bands is installed vertically onto the pack frame. The second is pivotally adjustable and extends down and forward of the first at an angle from the vertical of about 60 degrees. The second may also be constructed so as to pivot back of the first a similar angle when not in use. A plurality, preferably three, of hook and loop fastener strips are attached to each end of the fixed vertical C-band and removably affix the device to the backpack. Alternatively, add-on buckles and/or the pack's own accessory straps may be utilized.

The back of the hood may be unitary or it may have overlapping flaps forming a vertical vent. These may be secured together with hook and loop fastener material or similar means. The overlapping flaps are used by the backpacker for optional ventilation or for personal headroom adjustment. One elbow hinge may be mounted on the outside of each side of the hood at the lower midpoints of the C-band sides or legs. Each such hinge preferably is a three-position hinge. They are used to hold the adjustable hood in upright (retracted), middle, and down (extended) positions. In the down position, the C-bands are separated by an arc of approximately 60°. Other preferred hinge means include tension-biased elastic cords.

An optional waterproof poncho may be attached to the hood to cover the pack and/or the backpacker if desired. Alternatively, the material of the rear flap or flaps may be extended downward to form a form of protective cape. The apparatus is designed to be easily and conveniently installed and removed. It may be fitted onto a variety of external and internal backpack frames with little or no modification.

Mosquito netting may be attached along the lower frame of the hood using hook and loop fastener material. This netting hangs down over the user's face. A drawstring sewn to the bottom thereof enables the netting to enclose the user's face and prevent mosquitoes from entering the hood enclosure.

An optional atomizing feature provides a cooling effect to the head of a user. One end of a small plastic tube connects to a self-contained reservoir comprising a water bottle or a water bladder. Alternatively, this tubing could be used to divert water from an existing water source used by the hiker. The other end of the tube connects to one end of a self-refilling bulb pump having integrated check valves that prevent leaking. The bulb pump and tube can be mounted where they are accessible to the hiker. Each squeeze of the pump delivers a measured portion of drinking water to the hiker.

Another tube of reduced diameter is removably connected to the opposite end of the bulb pump. This tube is routed on the inside of the lower hood to one or more of the fans. Located at the end of this tube is an adjustable atomizer spray nozzle. The nozzle is mounted directly behind the fan blades of the solar-powered motors. While the fan blades are spinning, each squeeze of the self-refilling bulb delivers small amounts of water into the enclosure of the hood. This water is directed onto the head of the user in the form of a cooling mist.

A trigger spray pump similar to that used in a typical spray bottle, or bulb pump of alternate design, could be substituted for the bulb pump of the preferred embodiment of the optional atomizing feature. Two tubes would still be attached between the spray pump, and used in the same manner. Alternatively, the reservoir may be self-pressurizing.

Features and Advantages

An object of this invention is to provide a backpack hood apparatus including first and second C-band frame members pivotally attached together at the opposing ends thereof, fabric covering the C-bands to form a sunshade hood; at least one fan attached below either C-band; power supply means for the at least one fan; and water mist or misting means having at least one nozzle attached in fluid cooperation with the at least one fan.

Another feature or object is means for removably attaching the apparatus to a backpack.

Another feature is that the power supply means preferably is a solar panel. However, the power supply means could be a replaceable or rechargeable battery or batteries.

Yet another feature is that an adjustable hinge attaches the solar panel to the top of the first C-band. Electrical wires connect the solar panel to the at least one fan.

Still another feature is that the water mist means further includes a water reservoir, at least one hose, and a pump—the hose or hoses connect the reservoir to the at least one nozzle.

Another feature is that preferably the attaching means is at least two self-mating strips or bands of hook and loop fastener material at each end of the C-bands (for a total of at least four bands of such material). Alternatively, the attaching means comprises buckles or straps on the side of the backpack.

Yet another feature is that the apparatus includes, in combination with the hood, a backpack having an external or internal frame and having a plurality of storage pockets. The self-mating bands of hook and loop fastener material wrap around tubes of an external frame. The reservoir is stored in a pocket or storage section Still other features are a vertical slit vent in the fabric and removable mosquito netting.

A further feature is that the mosquito netting is affixed to the second C-band by hook and loop fastener material.

Another feature is yet another backpack hood apparatus that includes: first and second rod C-bands each having two opposing ends, the C-bands pivotally attached together at the opposing ends thereof; fabric covering the C-bands and extending there between to form a sunshade hood; a pair of first friction pivot clamps through which the ends of the first C-band are slidably affixed; a pair of second friction pivot clamps through which the ends of the second C-band are slidably affixed; and a pair of pivot bolts, one pivot bolt extending through one clamp of the pair of first clamps and through one clamp of the pair of second clamps, and the remaining pivot bolt extending through the remaining clamp of the pair of first clamps and through the remaining clamp of the pair of second clamps. This apparatus further includes a pair of first elastic cords spaced outwardly of the clamp pairs and biased (i.e. stretched) between the first and second C-band frame members.

Another feature is the apparatuses are easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and will not be limiting. For example, words such as "upwardly," "downwardly," "leftward," and "rightward" would refer to directions in the drawings to which reference is made unless otherwise stated. Similarly, words such as "inwardly" and "outwardly" would refer to directions toward and away from, respectively, the geometric center of a device or area and designated parts thereof References in the singular tense include the plural, and vice versa, unless otherwise noted.

DRAWING REFERENCE NUMERALS

Figure 1:
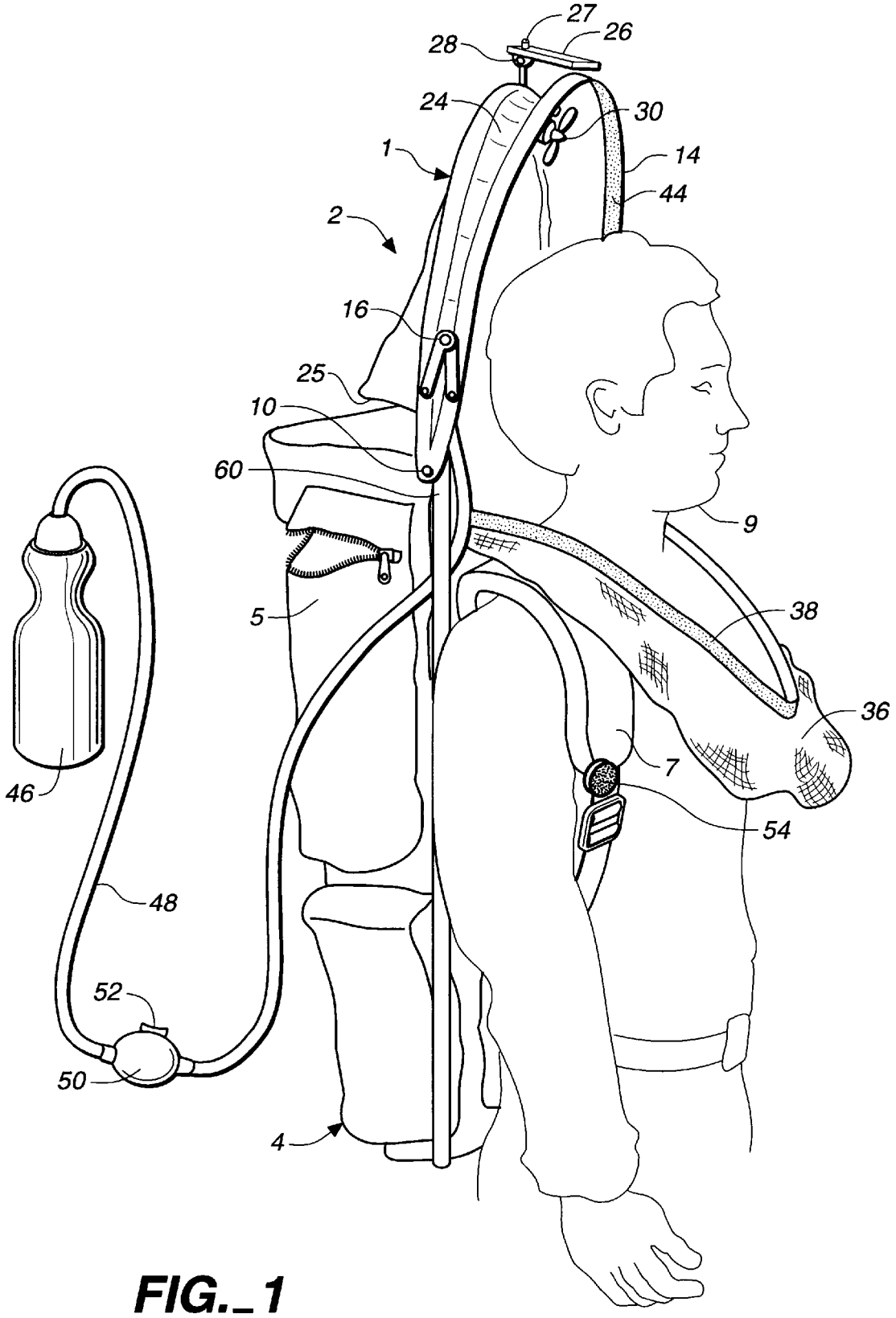
FIG. 1 is a perspective view of a first preferred embodiment of the invention in a first position.

1 backpack hood
2 hood and backpack assembly
4 backpack
5 pocket
6 frame
7 shoulder strap
9 user
10 pivot pin
12 fixed C-band bar
14 rotatable C-band bar
16 pivot hinge
18 legs
20 pivot
22 pivot pins
24 fabric
24*a* fabric flap
24*b* fabric flap
25 vent
26 solar panel
27 switch
28 hinge
30 fan
32 blades
33 wires
34 pin
35 bracket
36 mosquito netting
38 hook and loop fastener
40 clasp
42 drawstring
44 hook and loop fastener
46 reservoir
48 hose
50 pump
52 hook and loop fastener
54 hook and loop fastener
56 hose
58 nozzle
59 water mist
60 leg
62 hook and loop fastener
64 hook and loop fastener
101 backpack hood
102 hood and backpack assembly
104 backpack
105 pocket
106 frame
109 user
110 pivot pin
112 fixed C-band rod
114 rotatable C-band rod
115 grommet
116 elastic cord
117 elastic cord
122 bracket
124 fabric
124*a* fabric flap
124*b* fabric flap
125 vent
126 solar panel
127 switch
128 hinge
129 mounting ferrule
129*a* mounting ferrule
130 fan motor
130*a* fan motor
131 drive shaft
132 blades
132*a* blades
135 bracket
135*a* bracket
136 mosquito netting
140 clasp
142 drawstring
146 reservoir
148 hose
150 valve
150*a* pump
156 hose
158 nozzle
159 water mist
160 leg
162 attachment strap
222 stop ferrule
270 stop ferrule
272 inner pivot ferrule
274 outer pivot ferrule
276 leg
278 bore
301 backpack hood
302 hood and backpack assembly
304 backpack

309 user
310 pivot bolt
311 wing nut
312 fixed C-band rod
314 rotatable C-band rod
316 elastic cord
317 elastic cord
322 stop ferrule
324 fabric
324*a* fabric flap
336 mosquito netting
340 clasp
342 drawstring
360 leg
361 post
362 attachment strap
363 buckle
370 stop ferrule
371 stop ferrule
372 inner pivot clamp
374 outer pivot clamp
376 leg
378 bore
379 bore
380 drawstring
382 clasp
384 seam tube

DESCRIPTION OF PREFERRED EMBODIMENTS

Referring first in general to FIGS. 1–4, there is illustrated therein a backpack hood 1 of this invention for use in assembling, in combination with a backpack 4 of conventional design, a hood and backpack assembly 2.

As is common in the art, the backpack 4, such as a JANSPORT brand pack, Model D-2 or D-3, has an external frame 6 comprised of a series of interlocked aluminum tubes, a plurality of storage sections and/or pockets 5, and a pair of shoulder straps 7. The invention can be practiced on many other brands of external frame or internal frame backpacks with little or no modifications.

The backpack 4 is worn by a packer or user 9 in the conventional manner, i.e., on the back of the user 9 with the arms of the user 9 threaded under the shoulder straps 7.

In general, the backpack hood 1 is comprised of seamed fabric 24 stretched over a pair of internal hood frame members. The hood frame is comprised of semi-rigid plastic bands bent into semicircular hoop shapes or "C-bands." Alternatively, the C-bands are made of graphite, fiberglass, metal, plastic composite material, or the like. The C-bands of this invention may have rectangular cross-sections (bars), circular cross-sections (cylinders or rods—see FIGS. 6–13), or any other suitable cross-section.

A first C-band bar 12 remains fixed in position with respect to the frame 6 of the backpack 4 when the backpack hood 1 and backpack 4 are combined into the hood and backpack assembly 2. A second C-band bar 14 pivots with respect to the fixed C-band bar 12 and the frame 6 about a pair of pivot pins 10 that attach the opposing ends of the C-bands together.

Except at their ends, the C-bands are captured inside seam tubes sewn in the fabric 24.

Figure 2:
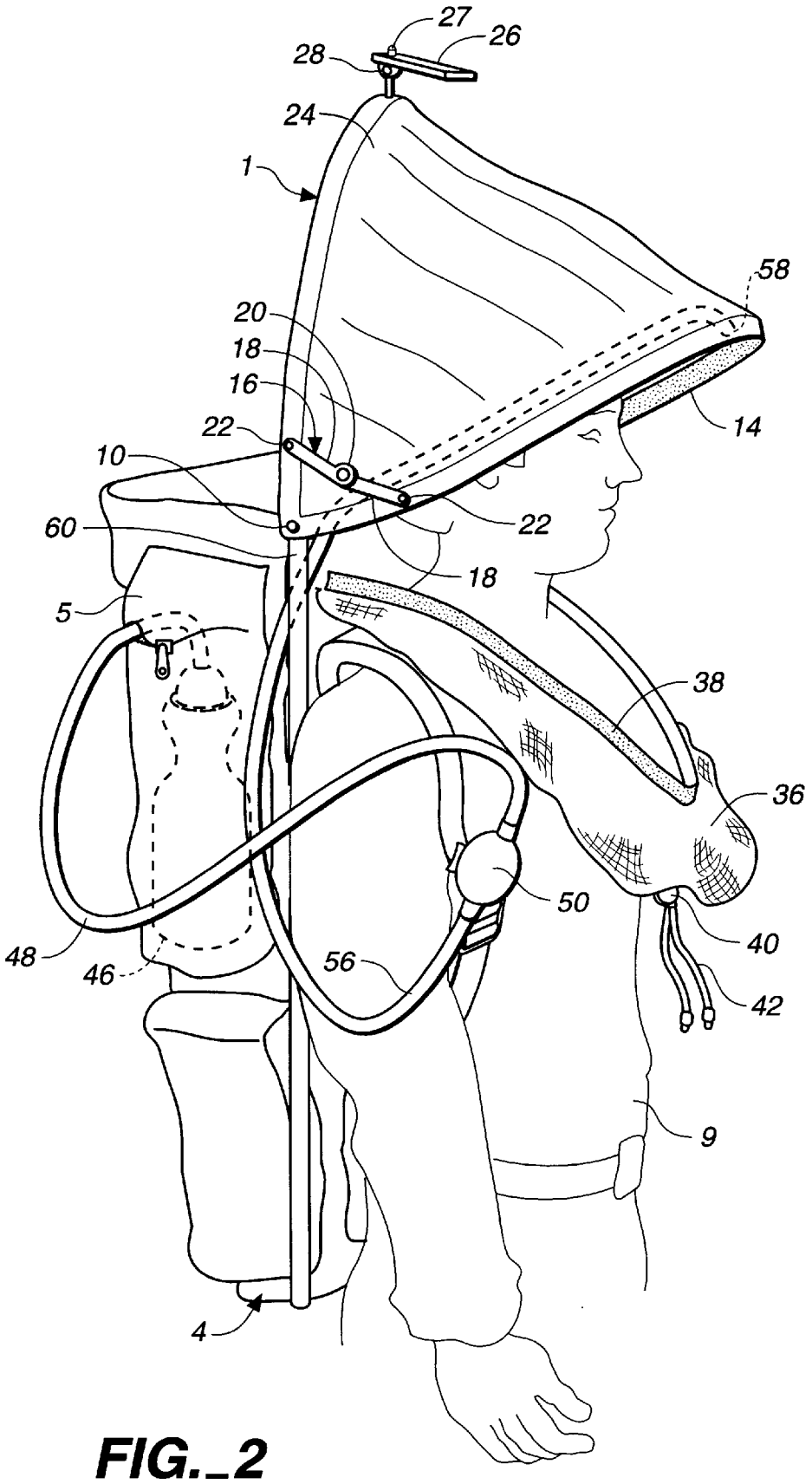
FIG. 2 is a perspective view of the embodiment of FIG. 1 in a second position.

Spaced inward from the ends of the C-bands 12, 14 are any suitable hinge means for allowing the C-bands to rotate with respect to each other into pre-selected fixed positions. In the embodiment of FIGS. 1–4, the hinge means comprises a pair of elbow pivot hinges 16, each arranged on the outside of the fabric 24 of the backpack hood 1. As best seen in FIG. 2, each pivot hinge 16 is comprised of two legs 18 joined together at their inner ends by a pivot 20. The outer ends of the legs 18 are attached to the C-bands by means of pivot pins 22. In this manner, the rotatable C-band bar 14 may be extended from an upright or retracted position (FIG. 1) to a down or fully extended position (FIGS. 2–4) that provides shelter from the sun to the user 9. The fixed C-band bar 12 remains at all times in an upright position. Preferably, the pivot hinge 16 has stops that allow it to assume a third stable position, namely, a middle or partially-extended position (not illustrated) that provides partial shade to the user 9. In the fully-extended down position, the C-bands 12, 14 are separated by an arc of approximately 60° or more.

An air vent 25 (FIG. 4) is formed in the rear of the backpack hood 1 by incorporating a vertical slit into the D-shaped portion of fabric 24 that is draped behind the fixed C-band bar 12, said slit separating the rear fabric into two panels 24*a*, 24*b*, which panels may overlap slightly at the slit. This vent may be secured open or closed, if desired, by appropriate strips of hook and loop fastener material or by hooked elastic cords (see, e.g., FIG. 7).

A low wattage solar panel 26 is attached by means of an adjustable hinge 28 to the upper side of the crown of the fixed C-band bar 12 or at any other suitable location. An on and off switch 27 directs the current output of the solar panel 26 by means of wires 33 routed through or along seams (or under sewn-in fabric tracks) in the fabric 24 to one or more fans 30 attached to the underside of the rotatable C-band bar 14. An additional or alternate fan or fans may be attached to the fixed C-band bar 12, preferably at the top or crown thereof.

A water reservoir 46, comprising a bottle or bladder, is adapted for storage in one of the pockets 5 of the backpack 4. A flexible tube or hose 48 leads from the reservoir to a suitable hand pump 50, which pump is squeezed to draw water from the reservoir 46. This action pushes water up into a second hose 56. The second hose 56 may lead from the pump into the same hood fabric seam as is threaded the rotatable C-band bar 14 (said seam not illustrated in the schematic view of FIG. 4). From a position adjacent bar 14 it travels to a fine misting nozzle 58 (discussed below). A patch of hook and loop fastener 52 is affixed to the pump 50. A mating patch of hook and loop fastener 54 is found on the shoulder strap 7 of the backpack 4 (FIG. 1). These may be mated together (FIG. 2) so that the pump 50 is always within ready grasp of the user 9. The second hose 56 may be temporarily removed from the pump 50, should the user wish to pump a drink of water into his or her mouth.

One self-refilling bulb pump 50 with integrated check valves is available from DesChutes Medical Products, Inc., of Bend Oreg., and is sold under the trademark HYDRO-PACER pump.

Figure 4:
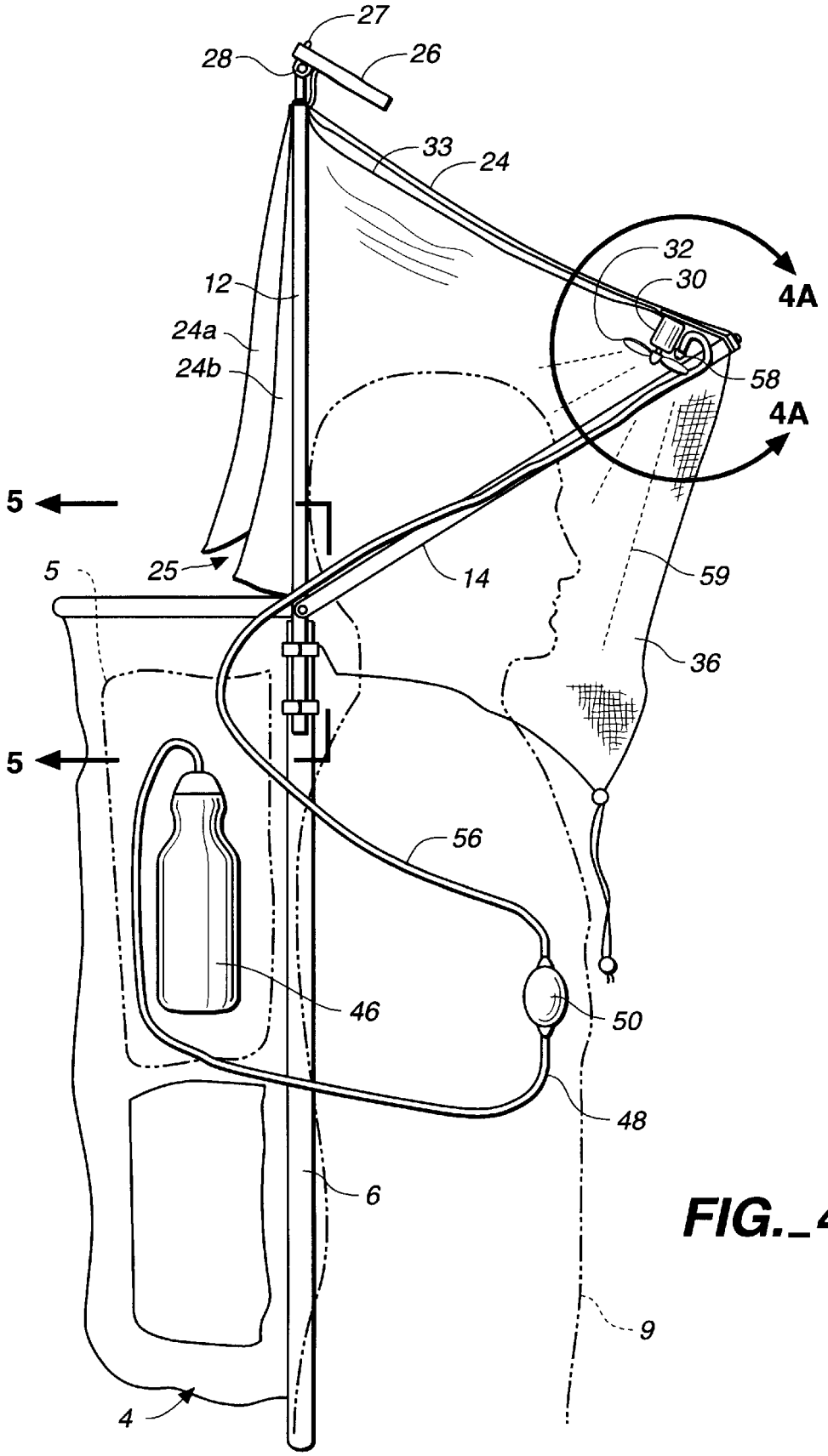
FIG. 4 is a schematic left side elevation illustrating the flow of mist and air within the hood assembly.
Figure 4A:
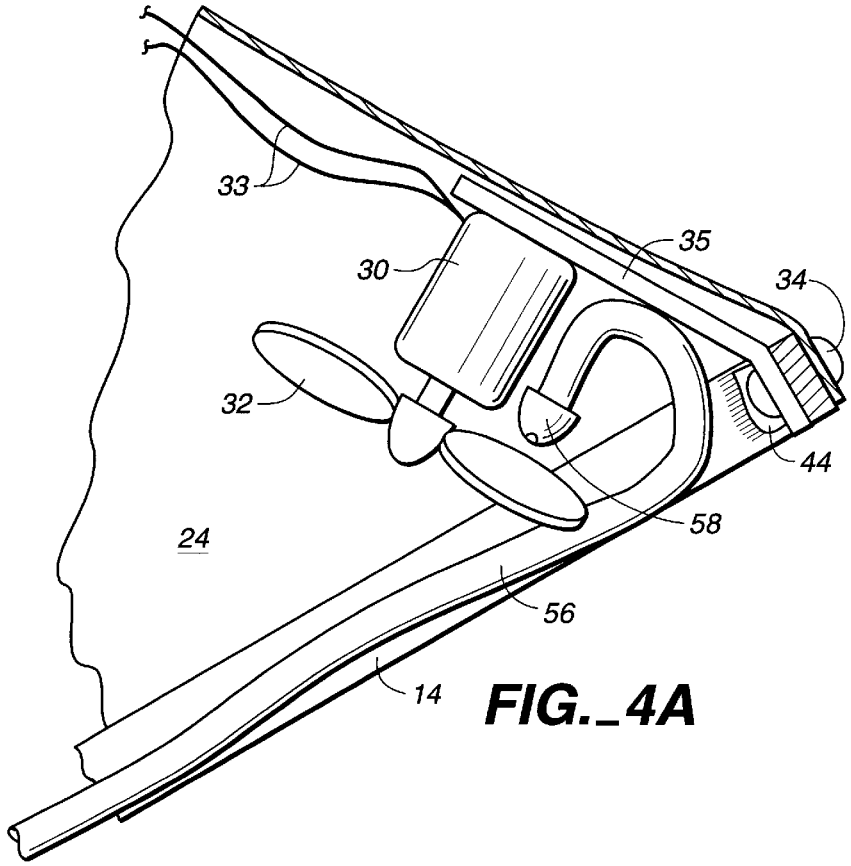
FIG. 4A is an enlarged broken elevation of the fan and nozzle area, taken along line 4A—4A of FIG. 4.

Turning briefly to the detail view of FIG. 4A, it can be seen that the nozzle 58 is positioned closely adjacent to the blades 32 of the fan 30. Both the fan 30 and the nozzle 58 may be affixed to an adjustable bracket 35 that is, in turn, affixed to the rotatable C-band bar 14 by means of a suitable screw, rivet or pin 34, or affixed to a ferrule-like hollow collar on the bar.

As perhaps best seen in FIG. 4, when the user 9 squeezes the pump 50, the fan blades 32 direct a fine cooling water mist 59 onto his or her head. The direction, intensity, and frequency of application of the water mist 59 are all under the control of the user 9.

Figure 3:
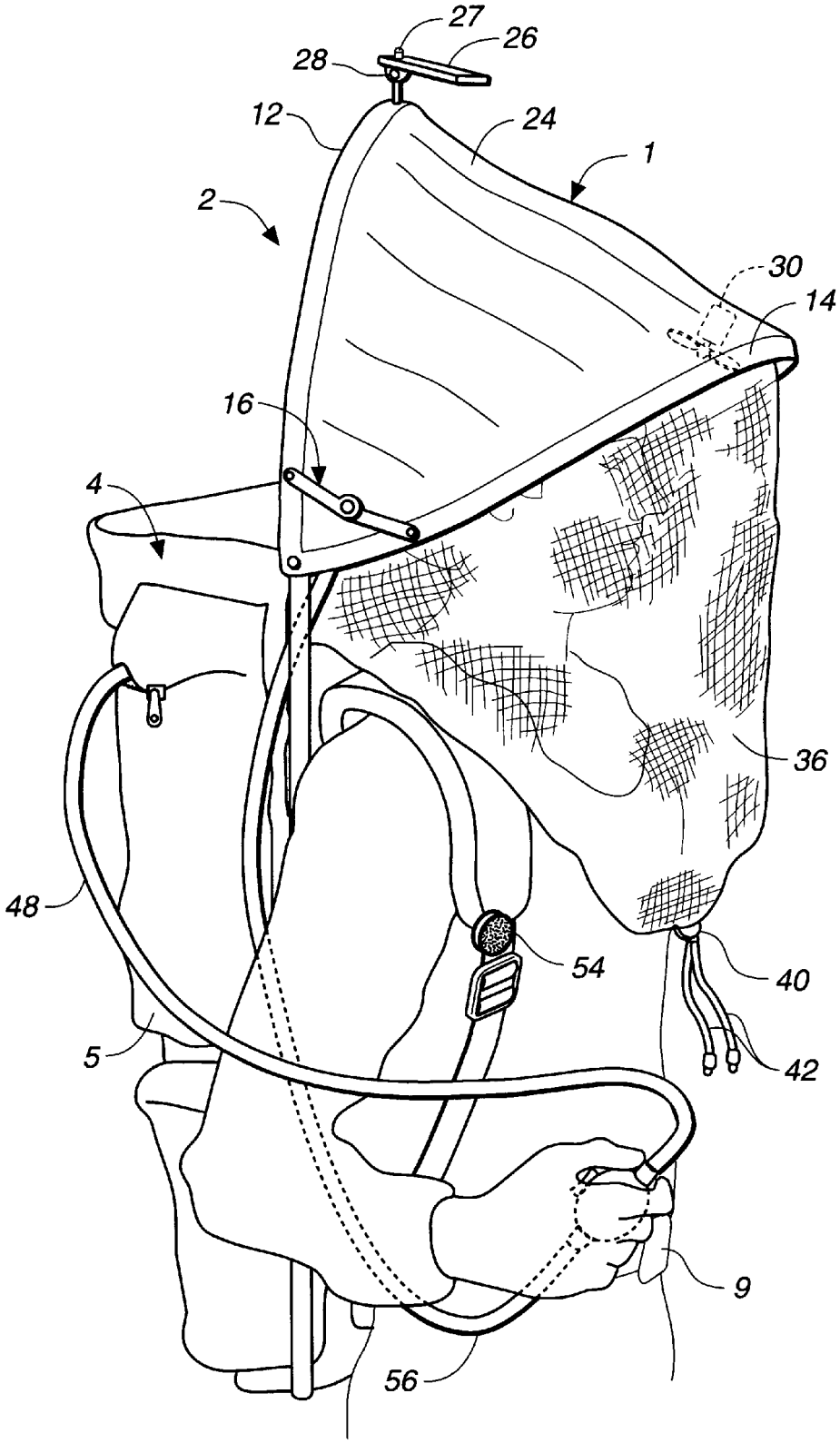
FIG. 3 is a perspective view of the embodiment of FIG. 1 in a third position.

Returning to the sequence of views shown in FIGS. 1–3, an optional mosquito netting 36 may be provided as another protective aspect of this invention. In FIGS. 1 and 2, the mosquito netting 36 is shown draped over the chest of the user 9 and nearly entirely released from the backpack hood 1. While this position is useful in illustrating a partial removal of the mosquito netting 36, in actual practice the netting is likely either to be entirely removed from the backpack hood 1 (and separately stowed) or fully attached thereto (FIG. 3) prior to the backpack 4 being slung over the shoulders of the user 9.

A first band of hook and loop fastener 38 is affixed to the upper edge of the mosquito netting 36. This band mates to a second band of hook and loop fastener 44, which latter band is, in turn, permanently sewn or otherwise attached to the hood fabric 24 in the immediate vicinity of the rotatable C-band bar 14. An adjustable clasp 40 on a drawstring 42 allows the mosquito netting 36 to be drawn up so as to form a mosquito-proof enclosure for the head of the user 9 when the backpack hood 1 is in the fully extended or "down" position shown in FIG. 3.

Figure 5:
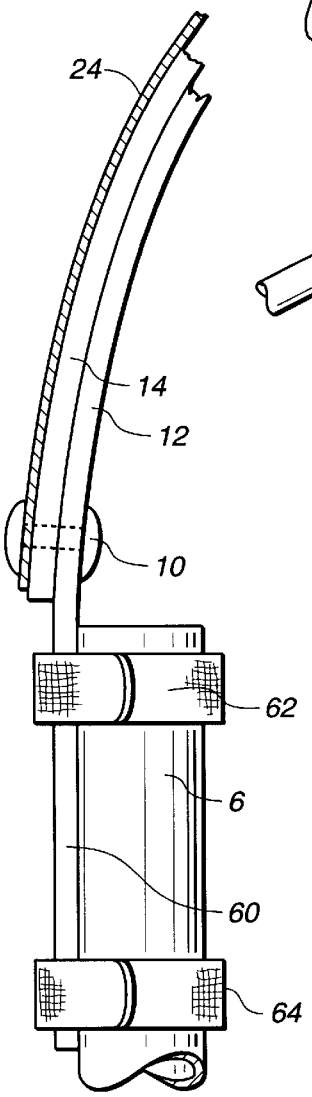
FIG. 5 is an enlarged broken side elevation of the frame attachment area, taken along line 5–5 of FIG. 4.

Turning briefly to FIG. 5, illustrated therein is one means of removably attaching the backpack hood 1 to an external frame backpack 4 to form a hood and backpack assembly 2. Each end of the fixed C-band bar 12 extends down past the pivot pin 10 a distance sufficient to form a free leg 60. Affixed thereon is a first self-mating band of hook and loop fastener 62 and, spaced further downward, a second self-mating band of hook and loop fastener 64. These are wrapped around tubes of the backpack frame 6 and back onto themselves, thereby holding the entire backpack hood 1 in place.

In some packs, the frame ends extend upward in an arc and meet in the center—forming a single tube. For frames extending above the pack body, bands of hook and loop fastener in addition to bands 62, 64 may be used to provide further stability. Furthermore, traditional belt and buckle straps may be substituted for hook and loop fastener, as desired. Preferably, there are at least three self-mating attachment bands, although only two are shown in FIG. 5. Emplacement of these hook and loop fastener bands around portions of the frame 6 and around the fixed C-band bar 12 acts to fix band 12 with respect to the frame 6.

Referring next to FIGS. 6–9, there is illustrated therein a second preferred backpack hood 101 of this invention for use in assembling, in combination with a backpack 104 of conventional internal frame design, a hood and backpack assembly 102.

As is common in the art, the backpack 104, such as an ARCFLEX ASTRALPLANE brand internal frame pack made by Dana Design, has a plurality of storage sections and/or pockets 105 and a pair of shoulder straps (not illustrated). The backpack 104 is worn by a packer or user 109 in the conventional manner.

In general, the backpack hood 101 is comprised of seamed fabric 124 stretched over a pair of internal hood frame members. The hood frame is comprised of semi-rigid cylindrical fiberglass rods bent into semicircular C-bands. Alternatively, the C-band rods may be made of graphite, metal, plastic composite material, or the like, and may have any suitable cross section.

A first C-band rod 112 remains fixed in position with respect to the backpack 104 when the backpack hood 101 and backpack 104 are combined into the hood and backpack assembly 102. A second C-band rod 114 pivots with respect to the fixed C-band rod 112 and the frame 106 about a pair of pivot pins 110 that attach the opposing ends of the C-bands together. Except at their ends, the C-bands are captured inside seam tubes sewn in the fabric 124.

Figure 6:
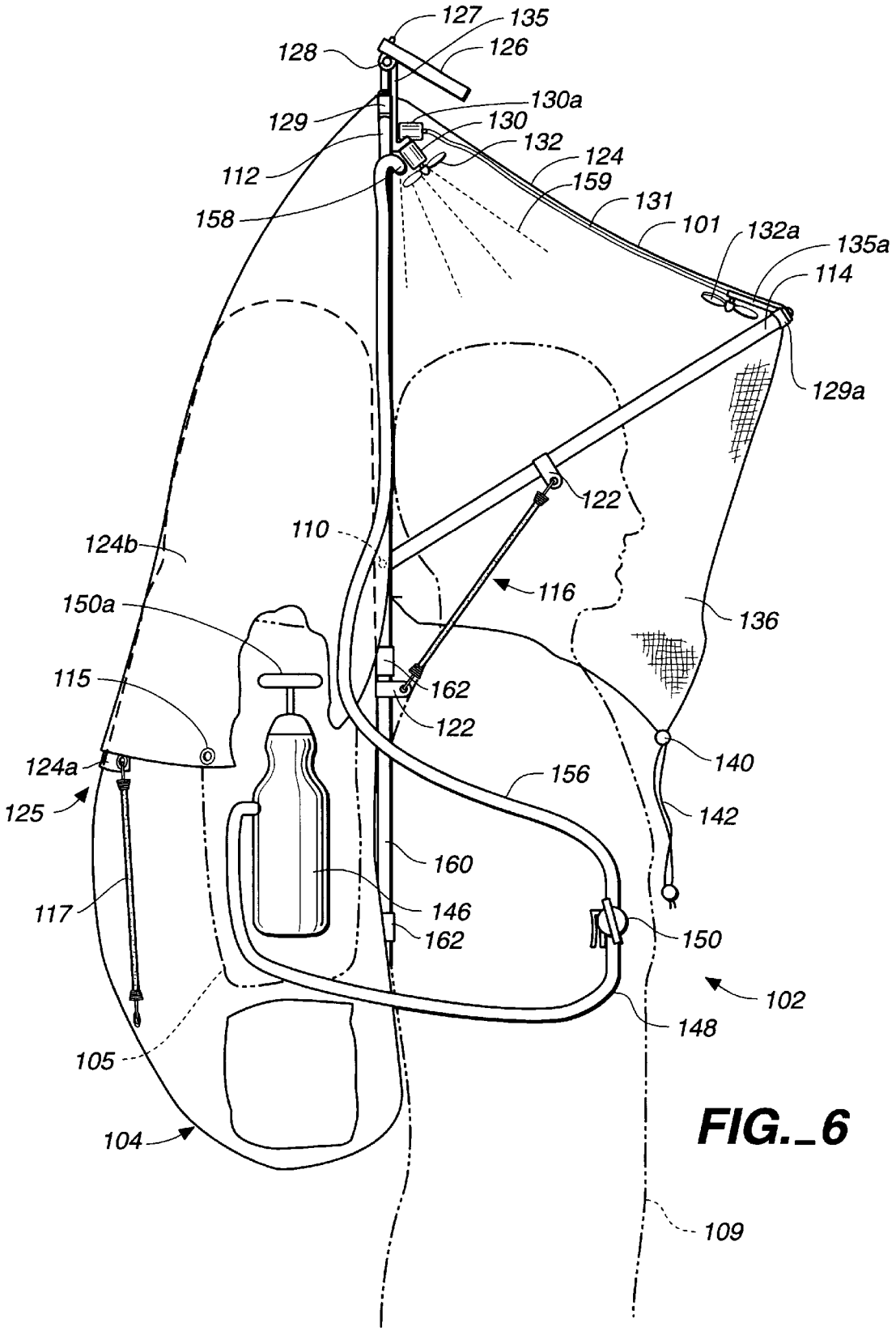
FIG. 6 is a schematic left side elevation of a second preferred embodiment of the invention.
Figure 7:
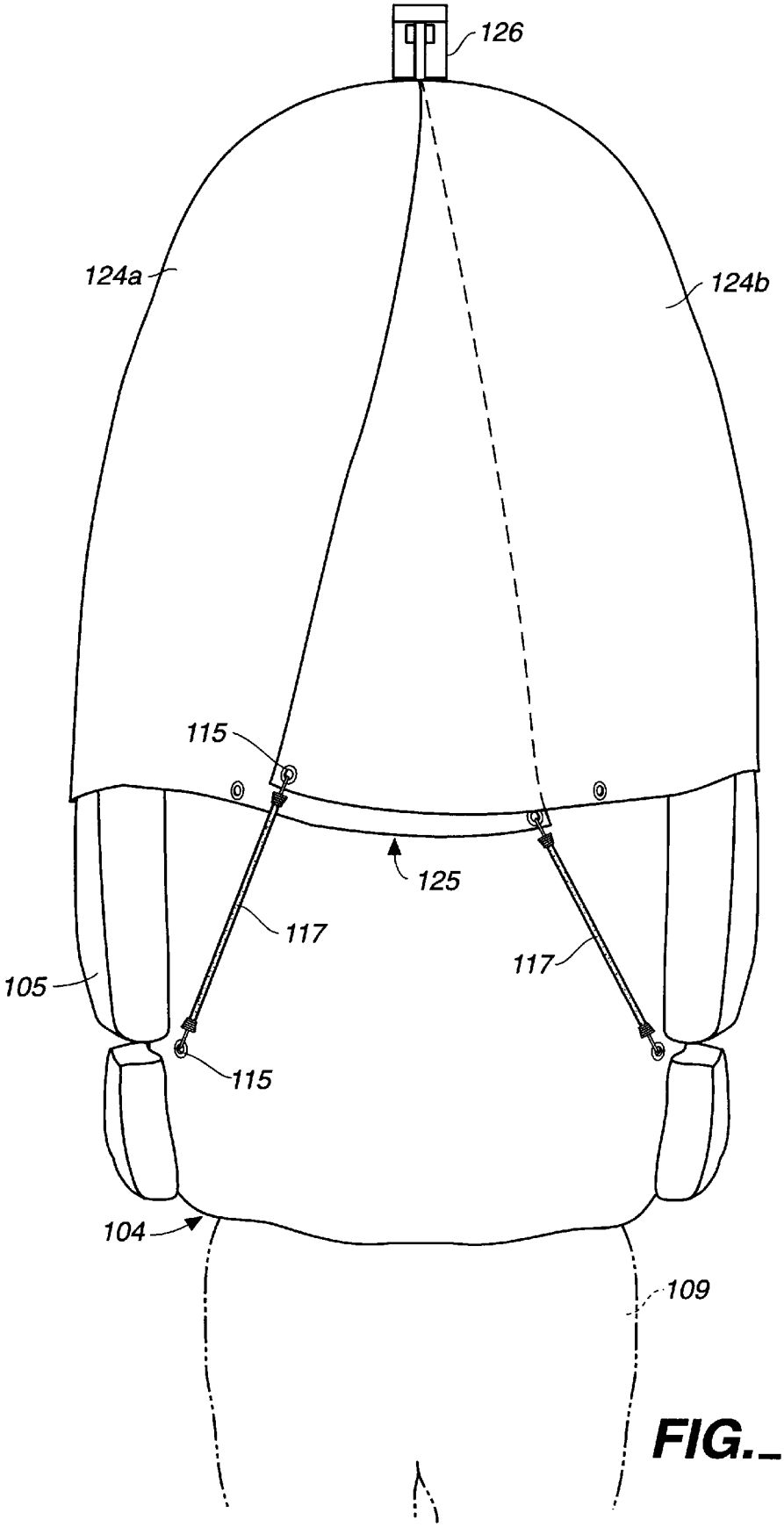
FIG. 7 is a rear elevation of the embodiment of FIG. 6.

Spaced inward from the pivots 110 of the C-bands 112, 114 are any suitable hinge means, which, in the embodiment of hinge means illustrated in FIG. 6, include a pair of hooked elastic cords 116, such as BUNGEE brand cords. The outer end hooks of the cords 116 are attached to the C-bands by means of brackets 122. In this manner, the rotatable C-band rod 114 may be extended from an upright or retracted position (as in the embodiment of FIG. 1) to a down or fully extended position (see, e.g., FIGS. 2–4) that provides shelter from the sun to the user 109. The fixed C-band rod 112 remains at all times in an upright position. In the fully-extended down position, the C-band rods 112, 114 are separated by an arc of approximately 60° or more.

An air vent 125 is formed in the rear of the backpack hood 101 by incorporating a vertical slit into the D-shaped portion of fabric 124 that is draped behind the fixed C-band rod 112, said slit separating the rear fabric into two panels 124*a*, 124*b*, which panels may overlap slightly at the slit. This vent may be secured open or closed against the wind, if desired, by elastic cords 117 (FIG. 7) hooked into grommets 115 found at various points on the hood cover and the backpack. In this embodiment, the flaps 124*a* and 124*b* are enlarged to extend down over the top portion of the backpack 104 in the form of a cape to an extent large enough to provide significant rain protection to the pack, if needed.

A low wattage solar panel 126 is attached by means of an adjustable hinge 128 to the upper side of the crown of the fixed C-band rod 112. An on and off switch 127 directs the current output of the solar panel 126 to a fan 130 attached to the underside of the fixed C-band rod 112. A second fan may have its motor 130*a* attached to the fixed C-band rod 112 by means of a bracket 135, and be of the known type wherein its blades 132*a* are powered remotely by an elongated flexible cable drive shaft 131 encased in tubing. This allows the fan blades 132*a* to be attached directly to a bracket 135*a* that is, in turn, affixed to the rotatable C-band rod 114 by means of a mounting collar or ferrule 129*a* on the rod. Use of a remote-motor fan on the rotatable C-band rod 114 provides greater clearance between the user's forehead and the fan blades 132*a*—perhaps allowing the overall size of the hood canopy to be reduced. However, in suitable configurations, an integral-motor, such as fan motor 130, may be used on the rotatable C-band rod 114. Where more than one fan motor is used in a particular hood cover apparatus, either the solar panel will have to be enlarged, or additional solar panels provided.

A water reservoir 146, comprising a bottle or bladder, is adapted for storage in one of the pockets 105 of the backpack 104. The reservoir 146 is of a type which may be internally pressurized by means of an integral pump 150*a*, such as the COOL MATES tank available from Carter Enterprises of Chandler Arizona. A flexible tube or hose 148 leads from the reservoir to a suitable valve 150, which valve is opened to release pressurized water from the reservoir 146. This action pushes water up into a second hose 156. The second hose 156 leads from the pump preferably into the same hood fabric seam as is threaded the fixed C-band rod 112. From there it travels to a fine misting nozzle 158. The nozzle 158 is positioned closely adjacent to the blades 132 of the fan motor 130. Both the fan 130 and the nozzle 158 are affixed to the bracket 135, which bracket is, in turn, affixed to a mounting ferrule 129, as is the solar panel 126. Alternatively, one or more of these accessories may be mounted directly on holes in the mounting ferrule 129. When the user 109 turns the valve 150, the fan blades 132 direct a fine cooling water mist 159 onto his or her head. Similar misting means can be integrated with the fan blades 132*a*.

As before, an optional removable mosquito netting 136 may be provided. An adjustable clasp 140 on a drawstring 142 allows the mosquito netting 136 to be drawn up so as to form a mosquito-proof enclosure for the head of the user 109 when the backpack hood 101 is in the fully extended or "down" position shown in FIG. 6.

Also illustrated in FIG. 6 is an alternate means of removably attaching the backpack hood 101 to an internal frame backpack 104 to form a hood and backpack assembly 102. Each end of the fixed C-band rod 112 extends down past the pivot pin 110 a distance sufficient to form an elongated free leg 160, which leg preferably is detachable at the pin area. Affixed to the pack 104 are a pair (right and left) of first attachment straps 162 and, spaced further downward, a pair of second attachment straps 162. These are wrapped around the legs 160, thereby holding the entire backpack hood 101 in place. Where attachment straps are not incorporated into the backpack 104 as sold, hook and loop fastener means can be used as attaching means to form the hood and backpack assembly 102. Without an external frame, the hook and loop fasteners likely will have to be glued or sewn onto the pack.

Figure 8:
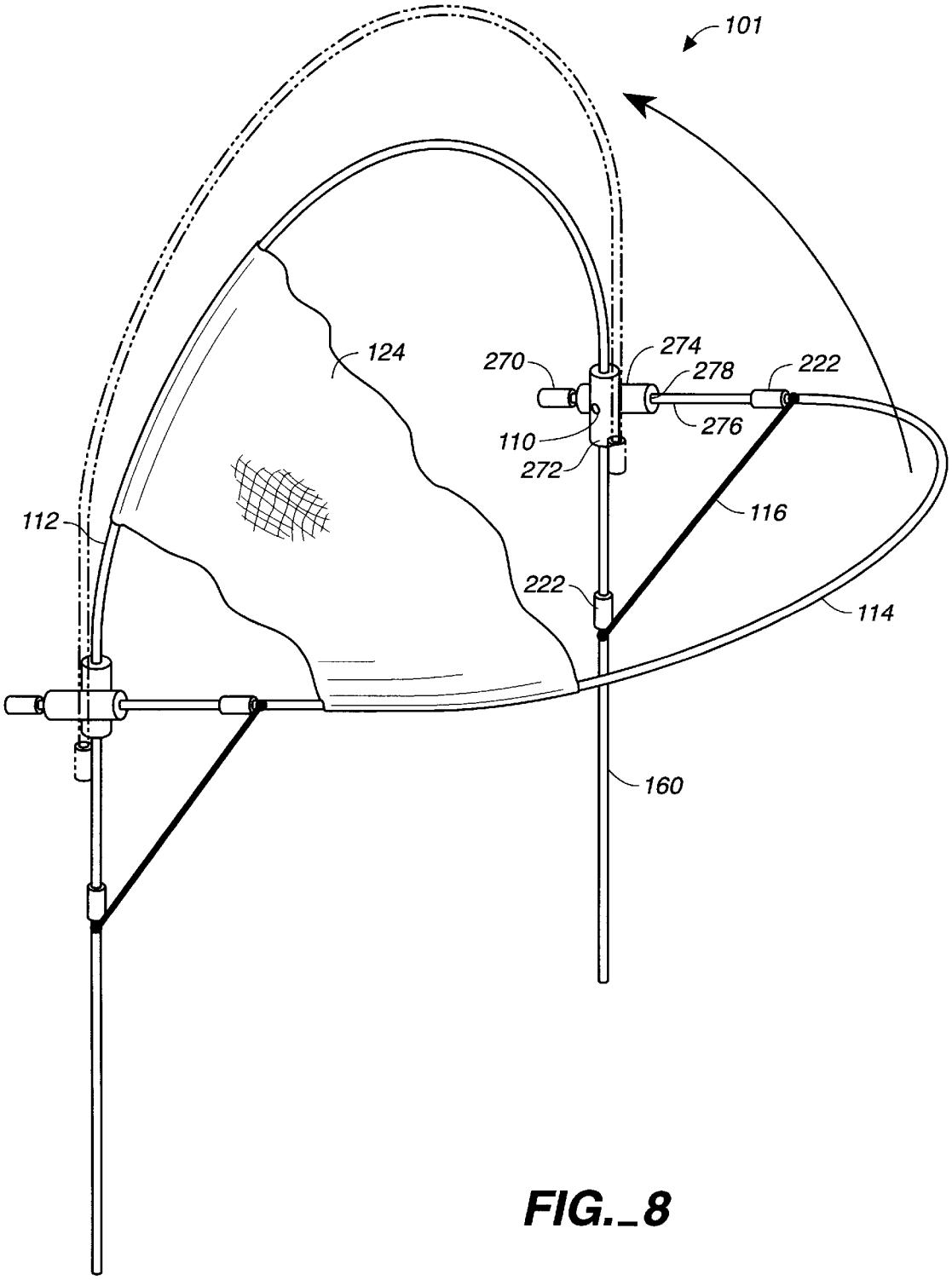
FIG. 8 is a schematic view of a third preferred embodiment of the invention, comprising alternate hinge means for the embodiment of FIG. 6, with the rotatable C-band in an extended position.
Figure 9:
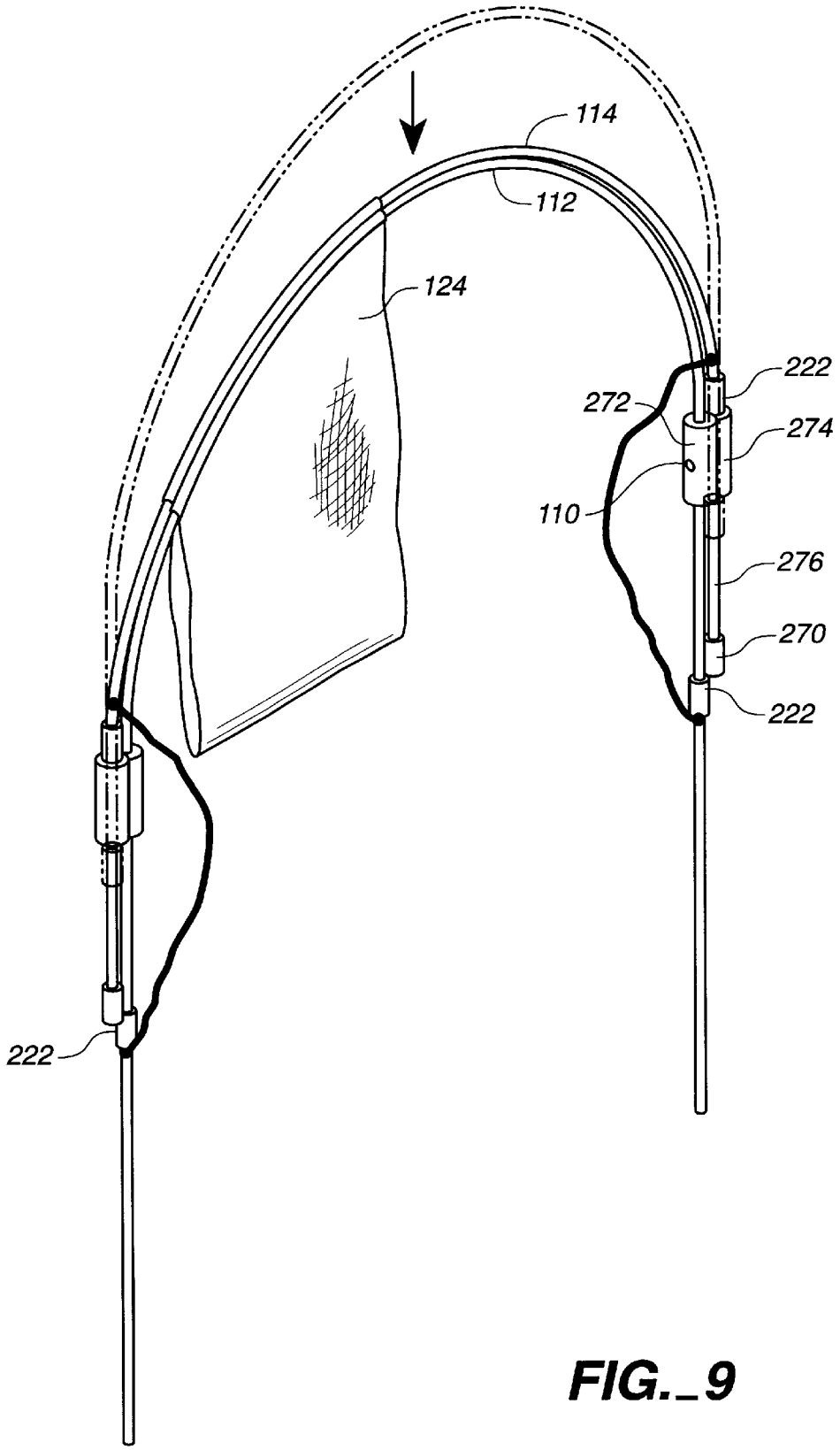
FIG. 9 is a schematic view of the alternate hinge means with the rotatable C-band in a stowed position.

A third embodiment of the invention, comprising yet a third form of C-band hinge means, is illustrated in FIGS. 8 and 9 for incorporation into the backpack hood 101 of the second embodiment. Only the rightward hinge means will be described, the leftward hinge means being identical thereto. The outer end hooks or rings of elastic cord 116 are attached to the C-bands 112 and 114 and held in place by means of one or more stop ferrules 222 per band. Outward of its stop ferrule 222, the rotatable C-band rod 114 forms a leg 276. At the tip of the leg 276 is an additional stop ferrule 270.

The pivot pin 110 extends through an inner pivot ferrule 272, through which ferrule also passes the fixed C-band rod 112. The pivot pin extends only part way into the outer pivot ferrule 274. This rotatably joins the inner and outer ferrules together, but leaves room for the axially longitudinal passage of a bore 278. Passing through the bore 278 is the leg 276 of the rotatable C-band rod 114.

In this manner, the rotatable C-band rod 114 may be extended from a first upright or retracted position (shown in phantom in FIG. 8) to a second down or fully extended position. The fixed C-band rod 112 remains at all times in an upright position. In the fully-extended down position, the C-band rods 112, 114 are separated by an arc of approximately 60°. It can be seen from an examination of FIG. 8 that the rotatable C-band rod 114 can also be inverted to a third position (not illustrated) behind the fixed C-band rod 112. This third position is useful when it is desired to move the backpack hood 101 completely back out of the way of the user's head.

FIG. 9 illustrates yet a fourth convenient position of the rotatable C-band rod 114 achievable through use of the hinge means of FIG. 8, namely a downwardly telescoped or "stowed" position. In the upright position shown in phantom in FIG. 9, the ferrule 270 is stopped flush against the outer pivot ferrule 274. To stow the backpack hood 101, e.g., for transportation in a car trunk or other limited space, the rotatable C-band rod 114 is pushed downward toward the fixed C-band rod 112. This causes the leg 276 to overcome the internal resistance of the bore 278 of the outer pivot ferrule 274 and to slide or telescope down into the fourth stowed position. Thus, the bored outer pivot ferrule 274, together with the stop ferrule 222 and the stop ferrule 270, comprise means for telescopically collapsing the C-band frame members 112, 114 into a position where the C-bands lie closely adjacent to each other throughout those portions of their lengths that are formed inward of the pair of pivots 110.

It may be desirable to provide additional resistance to sliding the rotatable C-band rod 114 through the outer pivot ferrule 274 from the first, second or third positions to the fourth. An additional sleeve or ferrule may be provided on the leg 276 of the rod 114, between the stop ferrule 222 thereof and the outer pivot ferrule 274. This sliding-resistance ferrule will fit tightly enough to move only under intentional finger manipulation—not merely from tension in the elastic cord 116. In the first through third positions of the rotatable C-band rod 114, it will be stopped flush against the outer pivot ferrule 274. Before pushing the rotatable C-band rod 114 down into the fourth position, the sliding-resistance ferrule will be pushed up against the stop ferrule 222. Another desirable position for an extra ferrule would be on the inboard side of bracket 122, to sandwich there between the end loop of the elastic cord 116.

Referring next to FIGS. 10–13, there is illustrated therein a fourth preferred backpack hood 301 of this invention for use in assembling, in combination with a backpack 304 of conventional internal frame design, a hood and backpack assembly 302.

The backpack 304 may have any of a wide variety of commonly available arrangements of storage sections, pockets, straps, buckles and the like. The backpack 304 is worn by a packer or user 309 in the conventional manner.

In general, the backpack hood 301 is comprised of seamed fabric 324 stretched over a pair of internal hood frame members. The hood frame is comprised of semi-rigid cylindrical fiberglass rods bent into semicircular C-bands. Alternatively, the C-band rods may be made of other lightweight material and may have any suitable cross section.

A first C-band rod 312 remains fixed in position with respect to the backpack 304 when the backpack hood 301 and backpack 304 are combined into the hood and backpack assembly 302. A second C-band rod 314 pivots with respect to the fixed C-band rod 312 about a pair of pivot bolts 310 that attach the opposing ends of the C-bands together. Except at their ends, the C-bands are captured inside seam tubes sewn in the fabric 324.

Spaced inward from the pivots 310 of the C-bands 312, 314 are suitable hinge means comprising, in part, a pair of elastic cords 316. The outer ends of the cords 316 are looped or knotted to matched pairs of stop ferrules 322 on the C-bands (best seen in FIG. 13). In this manner, the rotatable C-band rod 314 may be extended from a first upright or retracted position (as in the embodiment of FIG. 1) to a second down or fully extended position (compare, e.g., FIGS. 10 and 2–4) that provides shelter from the sun to the user 309. The fixed C-band rod 312 remains at all times in an upright and essentially vertical position. In the fully-extended down position of the apparatus, the C-band rods 312, 314 are separated by an arc of approximately 60° or more.

Figure 11:
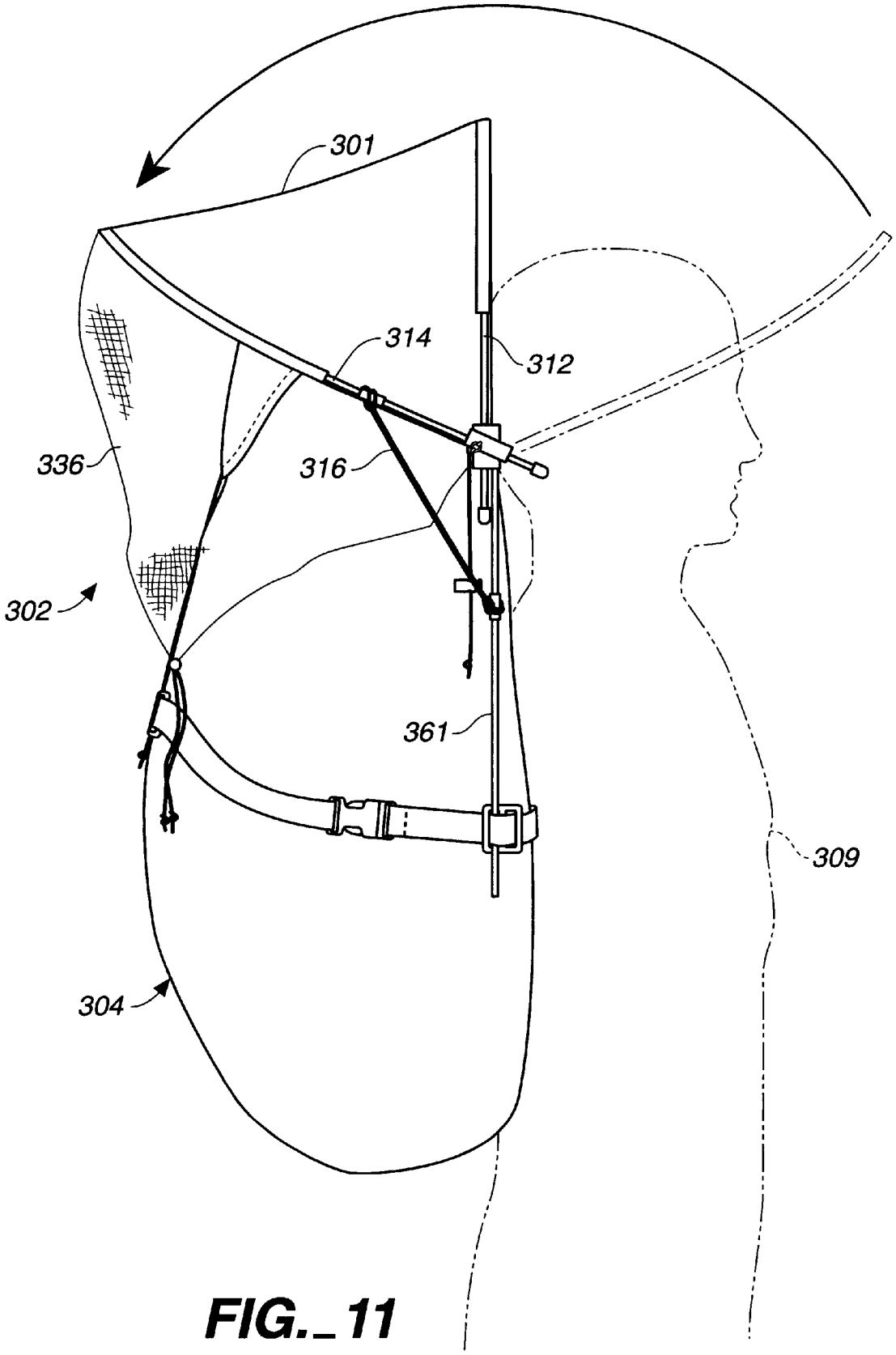
FIG. 11 is a schematic left side elevation of the embodiment of FIG. 10 showing its rotatable C-band in a first extended or down position (in phantom) and in a second rearward or back position.
Figure 12:
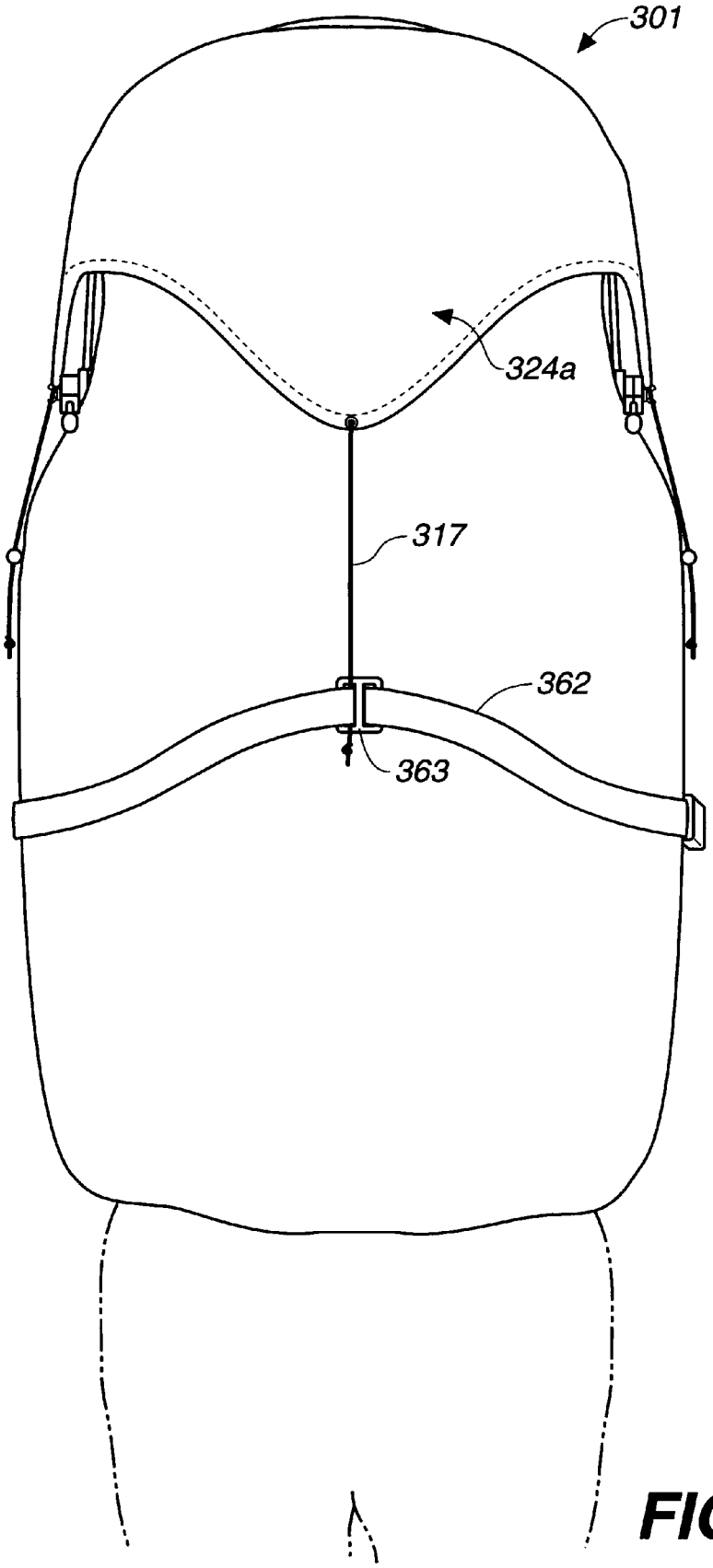
FIG. 12 is a rear elevation of the embodiment of FIG. 10.

FIG. 11 illustrates another position into which the rotatable C-band rod 314 may be rotated, namely, a rearward or back position wherein the rotatable C-band rod 314 forms an angle of 60° or more behind the fixed C-band rod 312. Tension on the two elastic cords 316 allow the rotatable C-band rod 314 to be snapped in place and held in either the down or the back positions.

A cape or fabric back flap 324*a* is formed in the shape of a large tongue at the rear of the backpack hood 301. This flap may be secured open or closed against the wind, if desired, by an elastic cord 317 (FIG. 12) hooked onto any suitable attachment strap 362 found on the backpack, or onto a buckle 363, a grommet, or other common attachment point found at various places on most existing backpacks.

As before, a removable mosquito netting 336 preferably is provided. An adjustable clasp 340 on a drawstring 342 allows the mosquito netting 336 to be drawn up so as to form a mosquito-proof enclosure.

Figure 10:
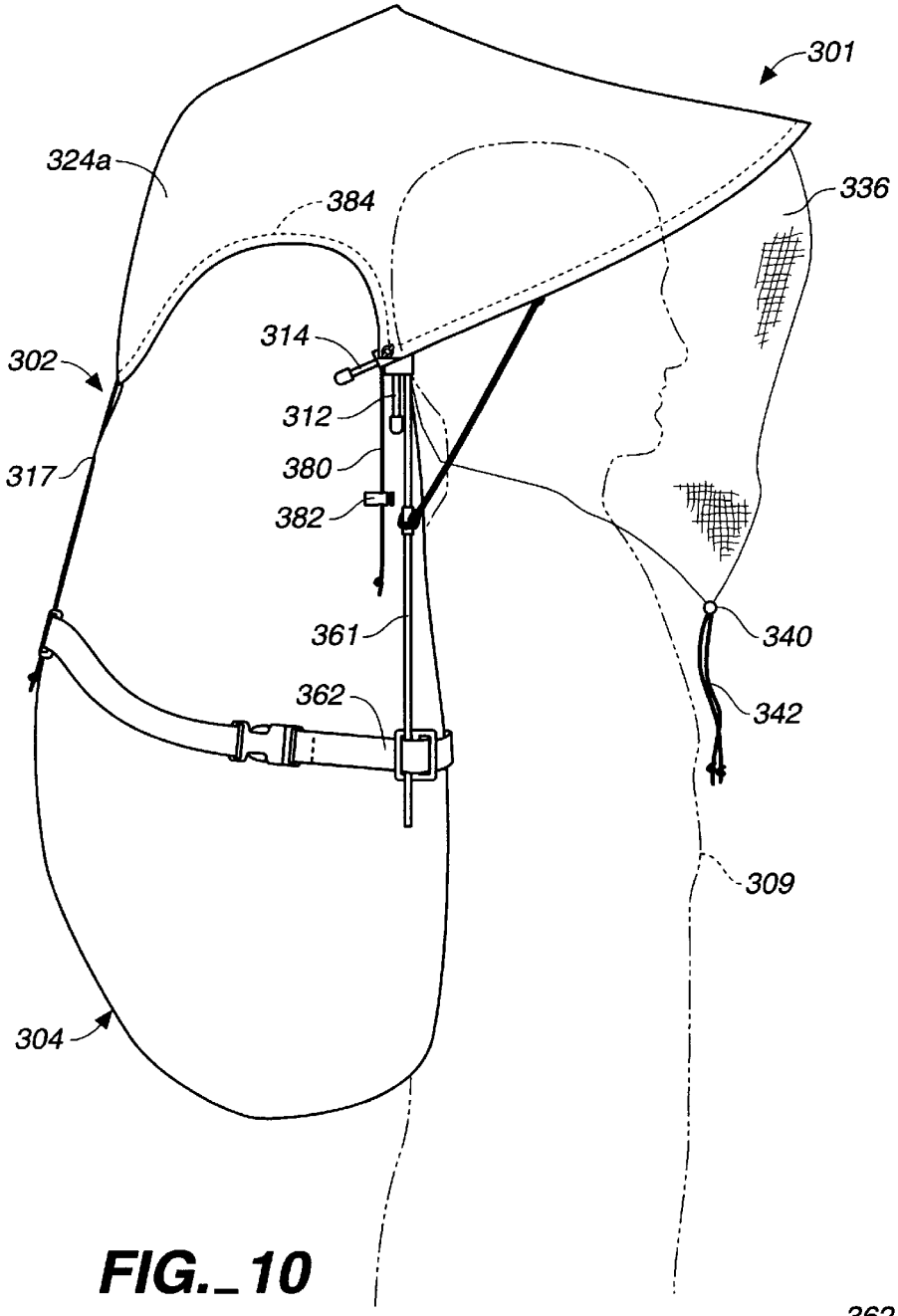
FIG. 10 is a schematic left side elevation of a fourth preferred embodiment of the invention.
Figure 10A:
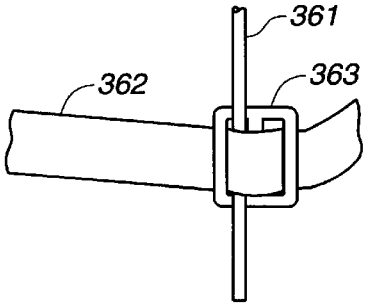
FIG. 10A is a broken detail view of the attaching means of the embodiment of FIG. 10.

Illustrated in FIGS. 10 and 10A is an alternate means of removably attaching the backpack hood 301 to a backpack 304 to form the hood and backpack assembly 302. A pair of posts 361 extend down past the pivot bolt 310 a distance sufficient to form an elongated free members, which posts preferably are detachable at the bolt area. Affixed to a typical pack 304 are one or more accessory attachment straps 362. A buckle 363 may be provided with the apparatus to be threaded on a attachment strap 362. The posts 361 may, in turn, be threaded through the buckle (FIG. 10A) behind the bight of the strap 362 formed within the buckle, thereby holding the hood and backpack assembly 302 in place. Where attachment straps are not incorporated into the backpack 304 as sold, hook and loop fastener material can be used as attaching means.

Figure 13:
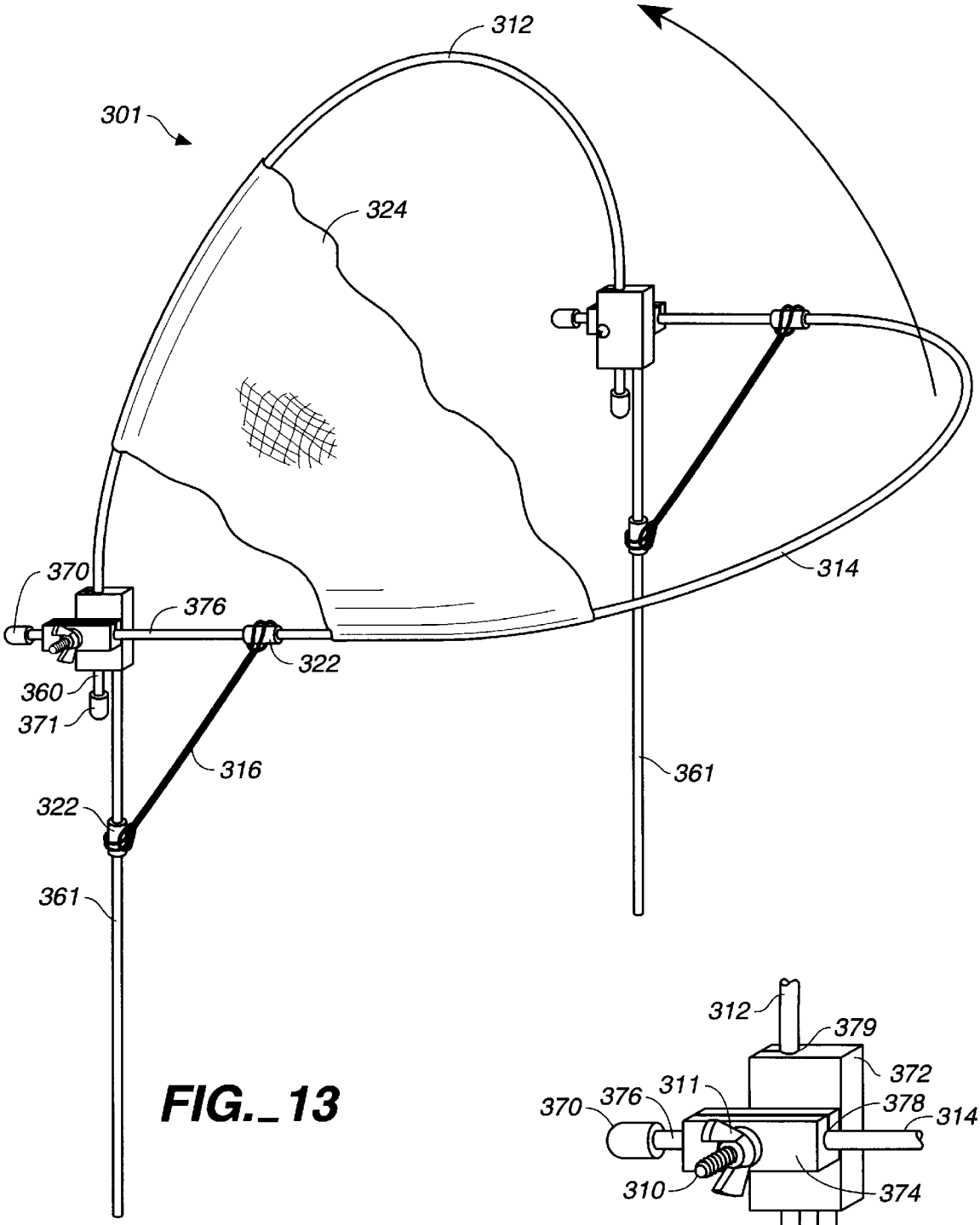
FIG. 13 is a schematic view of the hinge means of the embodiment of FIG. 10 with the rotatable C-band in the down position.
Figure 13A:
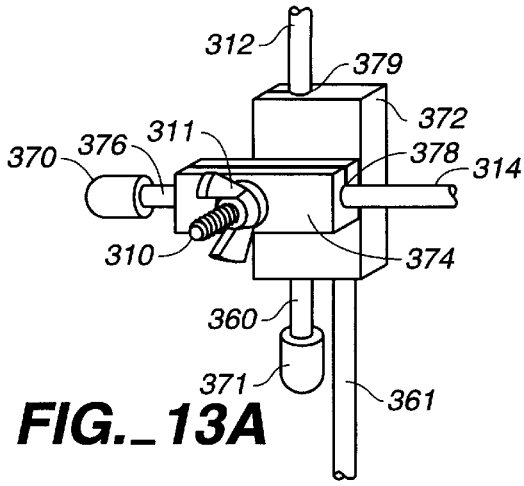
FIG. 13A is a broken detail view of the hinge means of the embodiment of FIG. 10.

Yet another embodiment of C-band hinge means is illustrated in FIGS. 13 and 13A and is incorporated into the backpack hood 301. Only the leftward hinge means will be described, the rightward hinge means being identical thereto. The opposed outer ends of the elastic cord 316 are attached to and biased or stretched between the C-band 314 and the post 361. They are held in place by means of stop ferrules 322. Outward of its stop ferrule 322, the rotatable C-band rod 314 forms a leg 376. At the tip of the leg 376 is an additional stop ferrule 370. At the end of the leg 360 of the fixed C-band rod 312 is a stop ferrule 371.

Turning to FIG. 13A, the pivot bolt 310 extends through an inner friction pivot clamp 372, through the bore 379 of which clamp also passes the leg 360 of the fixed C-band rod 312. The pivot bolt also extends through an outer friction pivot clamp 374, through the bore 378 of which clamp also passes the leg 376 of the rotatable C-band rod 314. A wing nut 311 holds the two friction clamps together, and also may be used to hold down the edge of the fabric 324 (not illustrated).

Loosening the wing nut 311 increases the size of the bores 378, 379, reducing friction on the C-band rods. This allows the user 309 to adjust the relative length of the C-bands 312, 314 by sliding their legs 360, 376, respectively, back and forth within the clamps 372, 374. Through such adjustments, the tension on the fabric 324 may be varied. Also, the device 301 may be telescoped down and partially collapsed for storage. By adding collapsibility to the fixed C-band rod 312, in addition to that present in the rotatable C-band rod 314 in prior embodiments, the user's effective headroom also may be varied.

An additional elastic drawstring 380 is captured inside a seam tube 384 sewn in the edge of the fabric flap 324*a*. A movable clasp 382 allows the length of the drawstring 380 to be varied, providing means for tightening the fabric flap 324*a* against the backpack 304.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like. For example, in the case of an internal frame backpack, strips of hook and loop fastener material of suitable number and length could be attached vertically to the pack in the vicinity of the internal frame members through use of known peel and attach adhesive backing. Mating portions of hook and loop fastener material could be sewn onto the ends of the waterproof fabric that covers the ends of the fixed vertical internal C-band of the hood. The user would be able to attach the hood to the internal frame pack simply by mating the respective hook and loop fasteners.

As another example, the means for attaching the hood to the backpack frame could comprise permanent rivets, pins or the like. Such means would be used were the hood and backpack assembly to be provided at the factory, rather than distributing the invention as an after-market accessory.

Yet another example of a preferred modification would be to provide means for attaching a metallized mylar reflective UV barrier to the top of the hood. Such a barrier could be removably attached by means of hook and loop fastener or it could be permanently glued directly to the fabric of the hood. A newly available material made up exclusively of mylar could be used to form the entire hood or canopy.

Still another variation would be to attach the solar panel to a rechargeable battery so that the device could be storing excess power when the fans are not in use. The charged batteries later could be used by the packer to power a flashlight or the like.

An equivalent variation of my invention would be to compose the C-bands of a plurality of sections of bars or rods assembled together by end connectors.

Therefore, the above description and illustrations should not be construed as limiting the scope of the invention, which is defined by the appended claims.

What is claimed is:

1. A backpack hood apparatus including:

first and second C-band frame members each having two opposing ends, the frame members pivotally attached together at the opposing ends thereof;

fabric covering the C-bands to form a sunshade hood;

at least one fan attached below at least one C-band;

power supply means for the at least one fan; and water mist means having at least one nozzle attached in fluid cooperation with the at least one fan.

2. The apparatus of claim 1 further including:

means for attaching the apparatus to a backpack.

3. The apparatus of claim 2 wherein:

the power supply means is a solar panel.

4. The apparatus of claim 3 further including:

an adjustable hinge attaching the solar panel to the top of the first C-band; and electrical wires connecting the solar panel to the at least one fan.

5. The apparatus of claim 3 wherein:

the water mist means further includes a water reservoir;

at least one hose; and a pump for pressurizing water in the at least one hose, the at least one hose connecting the reservoir to the at least one nozzle.

6. The apparatus of claim 5 wherein:

the attaching means is at least two self-mating bands of first hook and loop fastener material at each opposing end of the first C-band.

7. The apparatus of claim 6 further including:

a backpack having a frame with interlocking tubes, and a plurality of storage pockets, the self-mating bands of first hook and loop fastener material wrapped around tubes of the frame and the reservoir stored in a pocket.

8. The apparatus of claim 5 further including:

a slit vent in the fabric; and removable mosquito netting.

9. The apparatus of claim 8 wherein:

the mosquito netting is affixed to the second C-band by second hook and loop fastener material.

10. A backpack hood apparatus including:

first and second C-bands pivotally attached together at opposing ends thereof;

fabric covering the C-bands to form a sunshade hood;

at least one fan attached to and below the second C-band;

a solar panel for providing power to the at least one fan; and a pair of elbow hinges attached between the first and second C-bands for selectively rotating the C-bands with respect to each other from a first retracted position secured in place by the elbow hinges, to a second partially extended position secured in place by the elbow hinges, to a third fully extended position secured in place by the elbow hinges.

11. The apparatus of claim 10 further including:

a water reservoir;

first and second hoses;

a water misting nozzle attached in fluid communication with one fan; and a pump, the first hose connecting the reservoir to the pump, the second hose connecting the pump to the nozzle.

12. The apparatus of claim 10 wherein:

the C-bands are separated by an arc of about 60 degrees when in the fully extended position.

13. The apparatus of claim 12 further including:

hook and loop fastener means for attaching the apparatus to a backpack.

14. The apparatus of claim 13 further including:

an adjustable hinge attaching the solar panel to the top of the first C-band; and electrical wires connecting the solar panel to the at least one fan.

15. The apparatus of claim 13 wherein:

the hook and loop fastener attaching means is at least two self-mating bands of first hook and loop fastener material at each end of the first C-band.

16. The apparatus of claim 15 further including:

a backpack having a frame with interlocking tubes, and a plurality of storage pockets, the self-mating bands of first hook and loop fastener material wrapped around tubes of the frame and the reservoir stored in a pocket.

17. The apparatus of claim 16 further including:

a vent in the fabric; and removable mosquito netting, the mosquito netting affixed to the second C-band by hook and second loop fastener material.

18. A backpack hood apparatus including:

first and second C-band frame members each having two opposing ends, the frame members attached together at the opposing ends thereof by a pair of pivots;

fabric covering the C-bands to form a sunshade hood;

at least one fan attached below at least one C-band;

solar power supply means for the at least one fan; and hinge means for allowing the C-band frame members to rotate with respect to each other into pre-selected fixed positions.

19. The apparatus of claim 18 wherein:

the hinge means includes a pair of elastic cords biased between the C-band frame members.

20. The apparatus of claim 19 wherein:

the hinge means includes means for telescopically collapsing the C-band frame members into a position where the C-band frame members lie closely adjacent to each other throughout those portions of their lengths formed inward of the pivots.

21. A backpack hood apparatus including:

first and second rod C-bands each having two opposing ends, the C-bands pivotally attached together at the opposing ends thereof;

fabric covering the C-bands and extending there between to form a sunshade hood;

a pair of first friction pivot clamps through which the ends of the first C-band are slidably affixed;

a pair of second friction pivot clamps through which the ends of the second C-band are slidably affixed and completely pass through;

a pair of pivot bolts, one pivot bolt extending through one clamp of the pair of first clamps and through one clamp of the pair of second clamps, and the remaining pivot bolt extending through the remaining clamp of the pair of first clamps and through the remaining clamp of the pair of second clamps; and means for biasing the first and second C-bands into a down position of the apparatus wherein the first and second C-bands are held separated.

22. The apparatus of claim 21 further including:

a pair of downwardly depending elongated posts affixed within the pair of first clamps, one post to a clamp; and a pair of first elastic cords of the means for biasing, the pair of first elastic cords spaced outwardly of the clamp pairs and biased between the second C-band and the elongated posts.

23. The apparatus of claim 22 further including:

means for attaching the apparatus to a backpack.

24. The apparatus of claim 22 wherein:

the C-bands may be telescopically collapsed into a collapsed position of the apparatus where the C-bands lie closely adjacent to each other throughout those portions of their lengths formed inward of the pivot bolts.

25. The apparatus of claim 22 wherein:

the C-bands are able to rotate about the pivot bolts from the down position of the apparatus wherein the second C-band is down in front of the first C-band to a back position of the apparatus wherein the second C-band is in back of the first C-band.

26. The apparatus of claim 25 wherein:

the C-bands are separated by an arc of about 60 degrees when the apparatus is in the down position and when the apparatus is in the back position.

27. A backpack hood apparatus including:

first and second rod C-bands each having two opposing ends, the C-bands pivotally attached together at the opposing ends thereof;

fabric covering the C-bands and extending there between to form a sunshade hood;

a pair of first friction pivot clamps through which the ends of the first C-band are slidably affixed;

a pair of second friction pivot clamps through which the ends of the second C-band are slidably affixed;

a pair of pivot bolts, one pivot bolt extending through one clamp of the pair of first clamps and through one clamp of the pair of second clamps, and the remaining pivot bolt extending through the remaining clamp of the pair of first clamps and through the remaining clamp of the pair of second clamps;

means for biasing the first and second C-bands into a down position of the apparatus wherein the first and second C-bands are held separated;

a pair of downwardly depending elongated posts affixed within the pair of first clamps, one post to a clamp;

a pair of first elastic cords of the means for biasing, the pair of first elastic cords spaced outwardly of the clamp pairs and biased between the second C-band and the elongated posts; and means for attaching the apparatus to a backpack, wherein the attaching means includes a pair of buckles, through each of which buckles one of the pair of posts may be threaded.

28. A backpack hood apparatus including:

first and second rod C-bands each having two opposing ends, the C-bands pivotally attached together at the opposing ends thereof;

fabric covering the C-bands and extending there between to form a sunshade hood;

a pair of first friction pivot clamps through which the ends of the first C-band are slidably affixed;

a pair of second friction pivot clamps through which the ends of the second C-band are slidably affixed;

a pair of pivot bolts, one pivot bolt extending through one clamp of the pair of first clamps and through one clamp of the pair of second clamps, and the remaining pivot bolt extending through the remaining clamp of the pair of first clamps and through the remaining clamp of the pair of second clamps;

means for biasing the first and second C-bands into a down position of the apparatus wherein the first and second C-bands are held separated;

a pair of downwardly depending elongated posts affixed within the pair of first clamps, one post to a clamp;

a pair of first elastic cords of the means for biasing, the pair of first elastic cords spaced outwardly of the clamp pairs and biased between the second C-band and the elongated posts;

a back flap formed by the fabric, the back flap extending in back of the first C-band, starting adjacent to the first C-band; and removable mosquito netting attached to the fabric adjacent to the second C-band.

29. The apparatus of claim 28 further including:

a seam tube in an edge of the back flap;

a second elastic cord in the seam tube of the back flap; and a third elastic cord depending down from the edge of the back flap.

30. A backpack hood apparatus including:

first and second rod C-bands each having two opposing ends, the C-bands pivotally attached together at the opposing ends thereof;

fabric covering the C-bands and extending there between to form a sunshade hood;

a pair of first friction pivot clamps through which the ends of the first C-band are slidably affixed;

a pair of second friction pivot clamps through which the ends of the second C-band are slidably affixed;

a pair of pivot bolts, one pivot bolt extending through one clamp of the pair of first clamps and through one clamp of the pair of second clamps, and the remaining pivot bolt extending through the remaining clamp of the pair of first clamps and through the remaining clamp of the pair of second clamps;

means for biasing the first and second C-bands into a down position of the apparatus wherein the first and second C-bands are held separated;

a pair of downwardly depending elongated posts affixed within the pair of first clamps, one post to a clamp;

a pair of first elastic cords of the means for biasing, the pair of first elastic cords spaced outwardly of the clamp pairs and biased between the second C-band and the elongated posts;

wing nuts on the pivot bolts;

first stop ferrules on the C-bands, onto which first stop ferrules the first elastic cords are affixed; and second stop ferrules on the C-band ends.

* * * * *